US012656076B2

(12) United States Patent
Bradshaw

(10) Patent No.: US 12,656,076 B2
(45) Date of Patent: Jun. 16, 2026

(54) ADJUSTABLE CANT DOUBLE BARREL SHOTGUN SUPPRESSOR SYSTEM

(71) Applicant: HuxWrx Safety Co. LLC, Millcreek, UT (US)

(72) Inventor: A. Kai Bradshaw, Millcreek, UT (US)

(73) Assignee: HUXWRX SAFETY CO. LLC, Millcreek, UT (US)

( * ) Notice: Subject to any disclaimer, the term of this patent is extended or adjusted under 35 U.S.C. 154(b) by 0 days.

(21) Appl. No.: 19/097,042

(22) Filed: Apr. 1, 2025

(65) Prior Publication Data

US 2025/0327637 A1 Oct. 23, 2025

Related U.S. Application Data

(60) Provisional application No. 63/572,419, filed on Apr. 1, 2024.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/40; F41A 21/42; F41A 21/36
USPC ..... 42/79; 89/14.4, 14.3; 181/223
See application file for complete search history.

(56) References Cited

U.S. PATENT DOCUMENTS

| | | | |
|---|---|---|---|
| 3,703,122 | A | 11/1972 | Farrington et al. |
| 8,316,751 | B2 | 11/2012 | Dillon |
| 10,094,633 | B2 | 10/2018 | Bertschinger et al. |
| 10,254,079 | B2 | 4/2019 | Schneider |
| 10,365,060 | B2 | 7/2019 | Schneider |
| 10,890,401 | B2 | 1/2021 | Sautmann et al. |
| 11,768,049 | B2 | 9/2023 | Paulson |
| 2010/0180758 | A1 | 7/2010 | Lessel |

FOREIGN PATENT DOCUMENTS

| | | |
|---|---|---|
| CN | 113310346 | 2/2023 |
| RU | 2307991 | 10/2007 |
| WO | 9603612 | 2/1996 |

*Primary Examiner* — Reginald S Tillman, Jr.
(74) *Attorney, Agent, or Firm* — Thorpe North & Western, LLP.

(57) ABSTRACT

A suppressor system for a multi-barrel firearm which includes a first tube and a second tube that extend through a housing. The first tube has a first barrel engagement interface and a first bore axis. The second tube has a second barrel engagement interface and a second bore axis. The first bore axis of the first tube and the second bore axis of the second tube define an angle. The first tube and the second tube are adjustable with respect to each other between a range of positions to vary the angle.

20 Claims, 5 Drawing Sheets

ADJUSTABLE CANT DOUBLE BARREL SHOTGUN SUPPRESSOR SYSTEM

CROSS REFERENCE TO RELATED APPLICATIONS

This application claims priority to U.S. Provisional Application No. 63/572,419, filed Apr. 1, 2024 which is incorporated herein by reference.

BACKGROUND

Discharging a firearm causes gases to be produced through rapid, confined burning of a propellant that accelerates a projectile. This typically creates a significant report and a muzzle flash of light. Often, it is desirable to reduce the amount of noise and light produced by discharging a firearm to reduce hearing damage to the operator or neighboring individuals and to reduce trackable signature in active operational scenarios. Firearm suppressors are typically connected to the muzzle end of a firearm to temporarily capture gas that exits the muzzle. Suppressor designs divert a portion of the discharge gas away from the boreline. In some cases, the suppressors designs can direct gases to a secondary chamber, such that the gas does not exit the suppressor by the same path as the projectile. Regardless, such diversion of gases results in reduced energy and quieter discharge of the firearm.

Providing suppressors for multi-barrel guns, such as a double barrel shotgun, is uniquely challenging. One reason is due to the fact that the barrels on multi-barrel guns are not parallel. This is at least partially due to a desire to produce a common focal point at a given distance, i.e. converging projectile pathways. For example, as shown in FIG. 1, a firearm 10 having a first barrel 12 and a second barrel 14 is shown, although not to scale. Installed in the end of the first barrel 12 is a first choke tube 20. Installed in the end of the second barrel 14 is a second choke tube 22. As shown by the dashed lines, the bore axes of the barrels 12 and 14 are slightly angled or canted to form an angle 16 such that their aim points intersect at a point of convergence 18. The angling or cant of the barrels 12 and 14 may not be uniform on different models, even from the same manufacturer. In addition, the spacing or vertical offset between the barrels may differ between firearms.

SUMMARY

This invention relates to an adjustable cant firearm suppressor system that is adapted for installation on multi-barrel guns having different barrel cant. The suppressor system can comprise a housing having two or more tubes. Each of the tubes is connectable to one of the barrels of the firearm. The cant of the tubes as well as spacing is adjustable to accommodate firearms having different cant. That is, the cant of the tubes is adjustable to match the cant of the barrels. Once the cant of the tubes is adjusted to match that of a firearm, the tubes can be locked into place by a locking mechanism.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
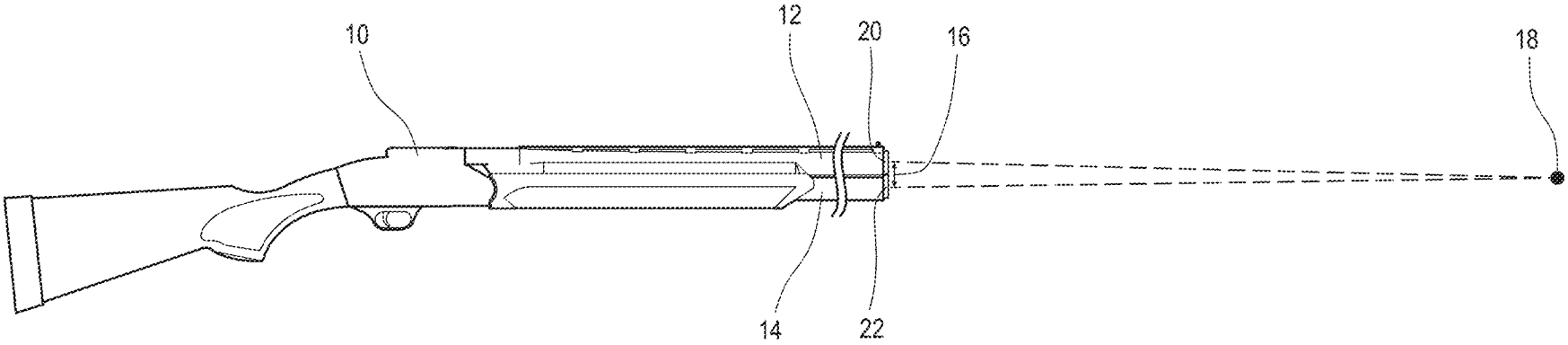
FIG. 1 is a side view of a double barrel shotgun showing the cant of the barrels in accordance with the prior art.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a baffle" includes reference to one or more of such structures and reference to "the entry" refers to one or more of such features.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 2%, and most often less than 1%, and in some cases less than 0.01%.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of." For example, "at least one of A, B and C" explicitly includes only A, only B, only C, or combinations of each.

As used herein, the term "multi-barrel firearm" refers to double barrel shotguns, including over-and-under and side-by-side shotguns; double barrel rifles, including over-and-under and side-by-side rifles; Gatling-type guns with rotating barrels; and multi-barrel pistols, such as derringer style pistols and the like.

As used herein, the term "suppressor" refers to a device installed on the end of a barrel of a firearm that reduces the acoustic intensity of a firearm discharge.

As used herein, the term "choke tube" refers to a cylindrical tube that screws into the end of a shotgun barrel. Different choke tubes may vary the muzzle constriction to affect the size and distribution of a pellet pattern at various distances.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

EXAMPLE EMBODIMENTS

A technology is described for a firearm suppressor system suitable for use with multi-barrel firearms. For example, a firearm suppressor system according to some embodiments of the present disclosure can be used to suppress muzzle reports of double barrel shotguns, including over-and-under and side-by-side shotguns. In other examples, a firearm suppressor system according to some embodiments of the present disclosure can be used to suppress muzzle reports of double barrel rifles, including over-and-under and side-by-side rifles. In still other examples, a firearm suppressor system according to some embodiments of the present disclosure can be used to suppress muzzle reports of firearms having more than two barrels, such as firearms with a Gatling-type rotating barrel assembly to deliver a sustained rate of fire. In still other examples, a firearm suppressor system according to some embodiments of the present disclosure can be used to suppress muzzle reports of multi-barrel pistols, such as derringer style pistols and the like. Thus, it will be appreciated that embodiments of the present disclosure can be utilized with almost any multi-barrel firearm.

Figure 2:
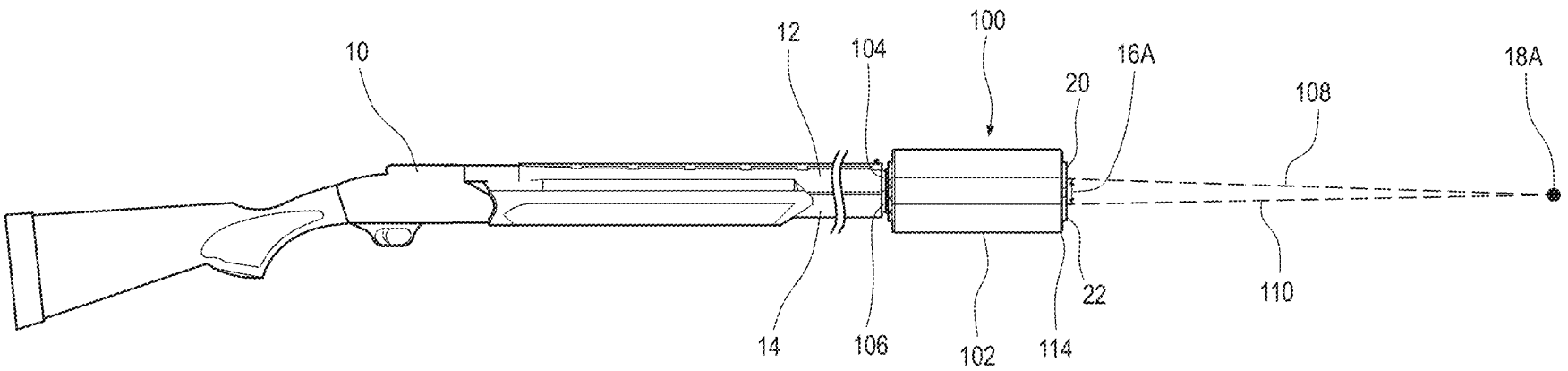
FIG. 2 is a side view of a double barrel shotgun having an adjustable cant firearm suppressor system according to the present disclosure installed on the end of the barrels.

Referring to FIG. 2, an adjustable cant firearm suppressor system 100 according to an exemplary embodiment of the present disclosure is shown installed on the barrels 12 and 14 of the firearm 10. The suppressor system 100 can suppress muzzle reports from the barrels 12 and 14. The system 100 includes a housing 102, a first tube 104 and a second tube 106. The first tube 104 can be coupled to an end of the first barrel 12. The second tube 106 can be coupled to an end of the second barrel 14. Both the first tube 104 and the second tube 106 extend into the housing 102. Installed on a distal end of the first tube 104 is an optional choke tube 20. Similarly, installed on a distal end of the second tube 106 is an optional choke tube 22. In some examples, the distal ends of each of the first and second tubes can optionally be free to any choke tubes.

As will be explained in more detail below, in the case of a threaded muzzle coupling, the first tube 104 can be connected to the first barrel 12 by unscrewing the choke tube 20 from the end of the first barrel 12 (see FIG. 1). The first tube 104 can be screwed into the end of the first barrel 12 in place of the choke tube 20. Likewise, the second tube 106 connects to the second barrel 14 by removing the choke tube 22 from the muzzle end of the second barrel 14 (see FIG. 1). The second tube 106 can be screwed into the end of the second barrel 14 in the place of the choke tube 22. The housing 102 can then be slid over both the first tube 104 and the second tube 106. The choke tube 20 can be coupled onto the distal end of the first tube 104. Similarly, the choke tube 22 can be installed onto the distal end of the second tube 106.

Based on the cant of the barrels 12, 14 of host firearm, the first tube 104 and the second tube 106 can be canted to maintain the angle or cant of the first barrel 12 and the second barrel 14. The first tube 104 can have a bore axis 108 and the second tube 106 can have a bore axis 110. The bore axis 108 and the bore axis 110 can form an angle 16A that is the same as angle 16 shown in FIG. 1. The bore axis 108 and the bore axis 110 can meet at a point of convergence 18A that is a common distance from the firearm 10 as the point of convergence 18 shown in FIG. 1. As a general guideline, cant angles can range from greater than 0° to 10°, in some cases 0.5° to 5°, in other cases 0.01° to 0.20°, and in still other cases 0.02° to 0.10°. In other terms, cant angles can range from about 0.5 to 3.5 minutes of angle (MOA) per barrel.

Figure 3:
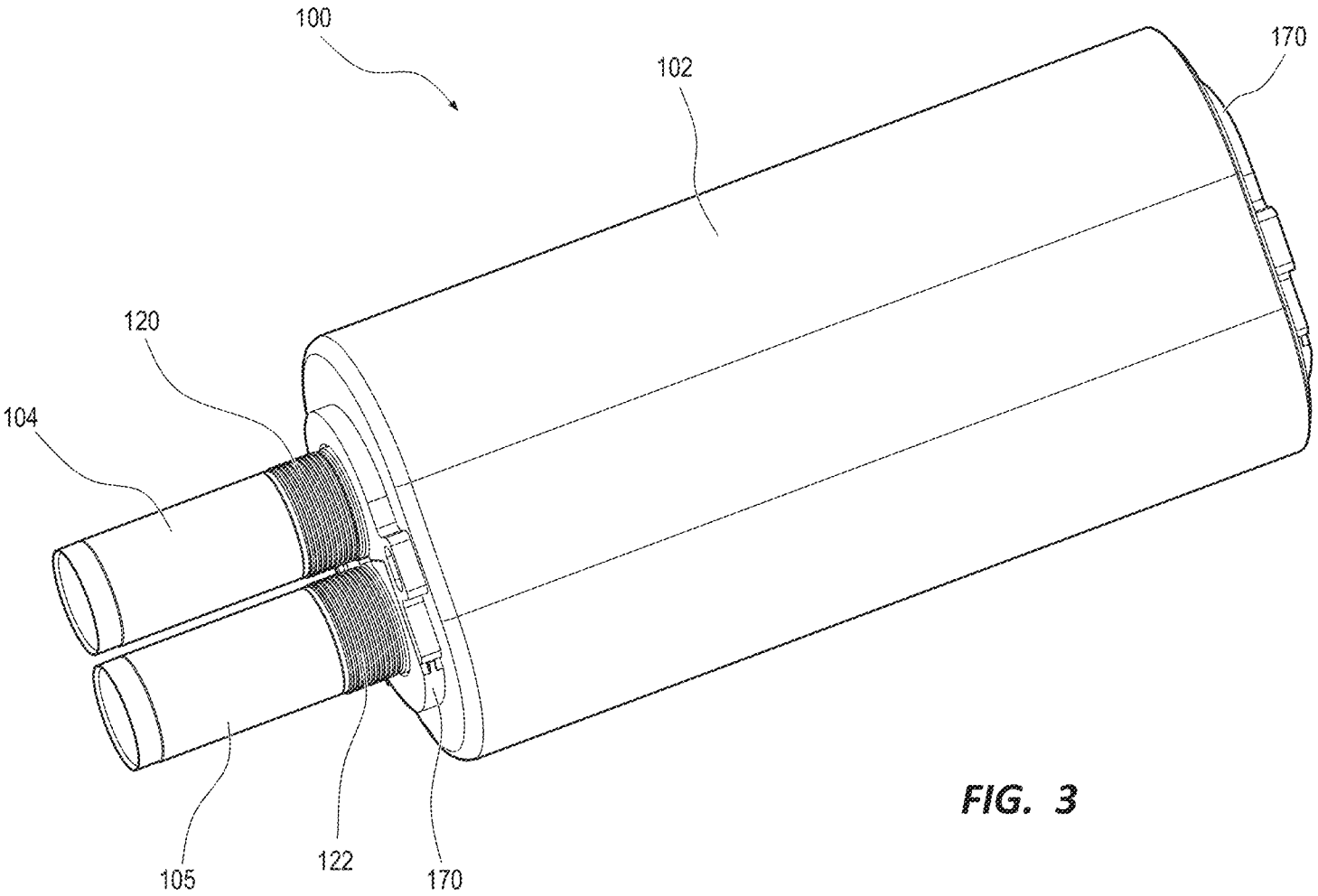
FIG. 3 is a view of an adjustable cant firearm suppressor system in accordance with an exemplary embodiment of the present disclosure.

Referring to FIG. 3, the first tube 104 and the second tube 106 extend into the housing 102. As will be described in more detail below, each of the first tube 104 and the second tube 106 can be held in place by a pair of locking mechanisms 170 oriented at respective proximal and distal ends of the housing.

The first tube 104 has a first barrel engagement interface 120 on its proximal end portion. Similarly, the second tube 106 has a second barrel engagement interface 122 on a proximal end portion. In an embodiment, the first barrel engagement interface 120 and the second barrel engagement interface 122 each comprises a male threaded portion that replicates the threads of a choke tube. Thus, it will be appreciated that the first barrel engagement interface 120 and the second barrel engagement interface 122 replace the choke tubes in the barrels 12 and 14. In one example, the suppressor housing uses the retaining clip on both sides that then drives the back end into the seat of the groove on the barrel extensions to capture both ends of the suppressor housing. In this way, the barrels are put under compression by the retaining clips seated against the housing.

Figure 4:
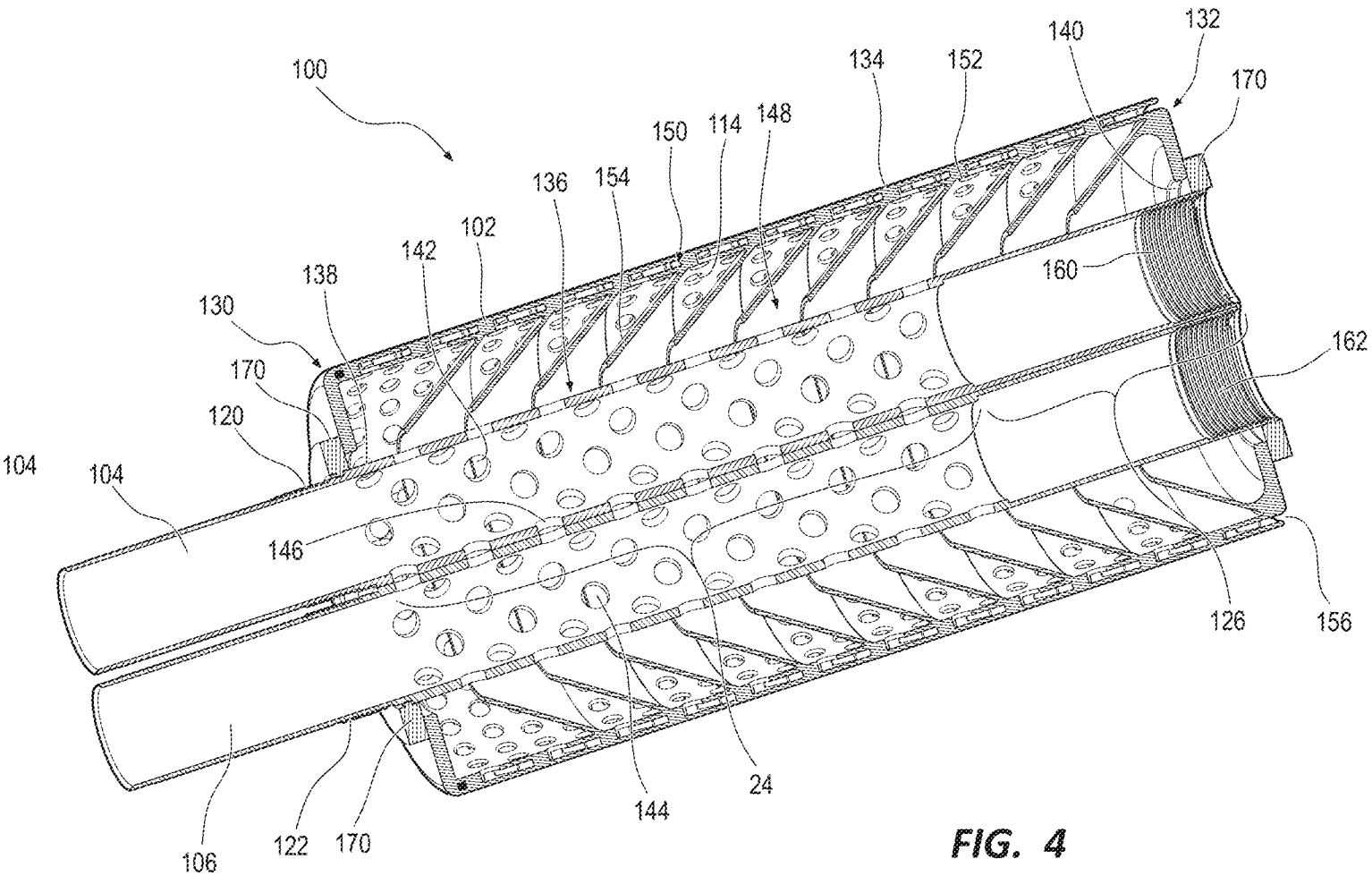
FIG. 4 is a cross sectional view of the system shown in FIG. 3.

Referring to FIG. 4, the housing 102 can comprise an inlet end 130 and an outlet end 132. The housing 102 can further comprise an outer sidewall 134 extending between the inlet end 130 and the outlet end 132.

A first opening 138 can be formed in the inlet end 130. A second opening 140 can be formed in the outlet end 132. In one example, the first opening 138 and the second opening 140 can be oblong in shape to accommodate both the first tube 104 and the second tube 106. The first opening 138 and the second opening 140 can be slightly larger than the combination of the first tube 104 and the second tube 106 such that the first tube 104 and the second tube 106 have some gap tolerance allowing lateral movement within each opening when installed into the housing 102. That is, the first tube 104 and the second tube 106 extend from the first opening 138 to the second opening 140 through the chamber 136 as shown in FIG. 4. As a general guideline, the gap tolerance can allow for 1 mm to 5 mm gap between an inner edge of the respective openings 138, 140 and an outer surface of the tubes 104, 106. Regardless of the first opening and second opening shape, an optional interface plate can be used to cover, obscure or otherwise block any substantial gap openings between the respective tubes and housing.

A middle portion 124 of the first tube 104 disposed within the housing 102 can comprise a first plurality of ports 142 that allow gases to pass from the inside of the first tube 104 and into the chamber 136. A middle portion 124 of the second tube 106 disposed within the housing 102 can comprise a second plurality of ports 144 that allow gases to pass from the inside of the second tube 106 and into the chamber 136. As an example, the middle portion 124 can be oriented in a rearward portion of the housing leaving a non-perforated section 126 forward of the middle portion. Although proportions can vary, the middle portion 124 can comprise from 30% to 90% of a length of the housing, and in some cases 50% to 75% of the length of the housing. A length of the middle portion can vary based on a balance of maintaining pressure behind a wad and/or projectile(s) and volume of diverted gases for reduction in sound signature. Furthermore, the ports 142, 144 can have a total surface area which is from 10% to 85%, in some cases less than about 40% to 80%, and other cases 15% to 40% of an inner tube surface. Similarly, a size of the ports can be maintained to reduce and avoid wad material and/or shotgun beads from impacting or catching on edges of the ports. As a general guideline, the ports can have a diameter from about 1 mm to 5 mm, and most often about 2 mm.

In one example alternative, select ports 146 can align between the first tube 104 and the second tube 106 to allow gases to transfer between the two. In another example, ports 142 in the first tube 104 do not align with ports 144 in second tube 106 such that there is substantially no direct fluid communication between the two tubes.

The outer sidewall 134, the inlet end 130, and the outlet end 132 can form a central chamber 136 inside of the housing 102. Within the central chamber, a primary expansion chamber 148 can include a plurality of baffles 154. An optional secondary expansion chamber 150 can be annularly oriented between the outer sidewall 134 and an intermediate wall 152. The intermediate wall 152 can function to segregate the central chamber into the primary expansion chamber 148 and secondary expansion chamber 150. A plurality of intermediate ports 114 can allow fluid communication and passage of gases between the primary expansion chamber 148 and the secondary expansion chamber 150. The intermediate ports 114 can be present in each sub-chamber formed by the baffles 154, or can be present in only a portion of the sub-chambers. The number, size and distribution of these intermediate ports can be varied to adjust back pressure. For example, semi-automatic shotguns can benefit from additional venting ports.

The secondary expansion chamber 150 can be entirely open, or can including diversion walls. In either case, the secondary expansion chamber 150 can include secondary exhaust ports 156 which allow at least a portion of gases to exit the suppressor separate from the boreline(s). In one alterative, the diversion walls can be helical walls oriented within the annular space of the secondary expansion chamber 150. Other non-limiting examples of diversion wall configurations can include zigzag patterns, helically serpentine (i.e. alternating clockwise-anticlockwise), and the like. In another example, although a single layer expansion chamber is shown, the secondary expansion chamber may also multiple include nested annular spaces which can be individually open or include similar diversion walls but which are fluidly connected to one another. For example, a first annular space can lead to a forward gap which leads toward a second annular space nested outward of the first annular space and then toward a rearward gap which leads gases into a third annular space as an example.

The outer sidewall 134 or (if present) the intermediate wall can include a plurality of baffles 154 extending inwardly from the inner surface. In one example, each of the plurality of baffles 154 can be angled towards the inlet end 130 of the housing 102. The plurality of baffles 154 can direct gases from the first and second plurality of ports 142 and 142 into the primary expansion chamber 148 and optionally to the secondary expansion chamber. As shown in FIG. 4, the first tube 104 and 106 pass between the free ends of the plurality of baffles 154.

As another example, features can be included to allow use of choke tube attachments which can be used to vary a shotgun discharge pattern. A distal end portion of the first tube 104 can comprise a first choke interface 160. A distal end portion of the second tube 106 can comprise a second choke interface 162. The first choke interface 160 and the second choke interface 162 can each comprise a female threaded portion for engage a male threaded portion of a choke tube. In firearms without choke tubes, e.g., rifles, the first choke interface 160 and the second choke interface 162 are not required and can be omitted from the design.

As discussed above, the first opening 138 and the second opening 140 are elongated to allow the first tube 104 and the second tube 106 some free play in the vertical direction (up and down). It will be appreciated that this free play allows the cant of the first tube 104 and the second tube 106 to be adjustable to match the cant of the barrels of a firearm. Cant angles vary among manufacturers and also vary among individual firearms or a common model. Accordingly, this system allows for such variations to be accommodated by allowing free play (e.g. up to 10 mm or up to 6 mm) for a variety of angles and spacing of adjacent barrels.

Figure 5:
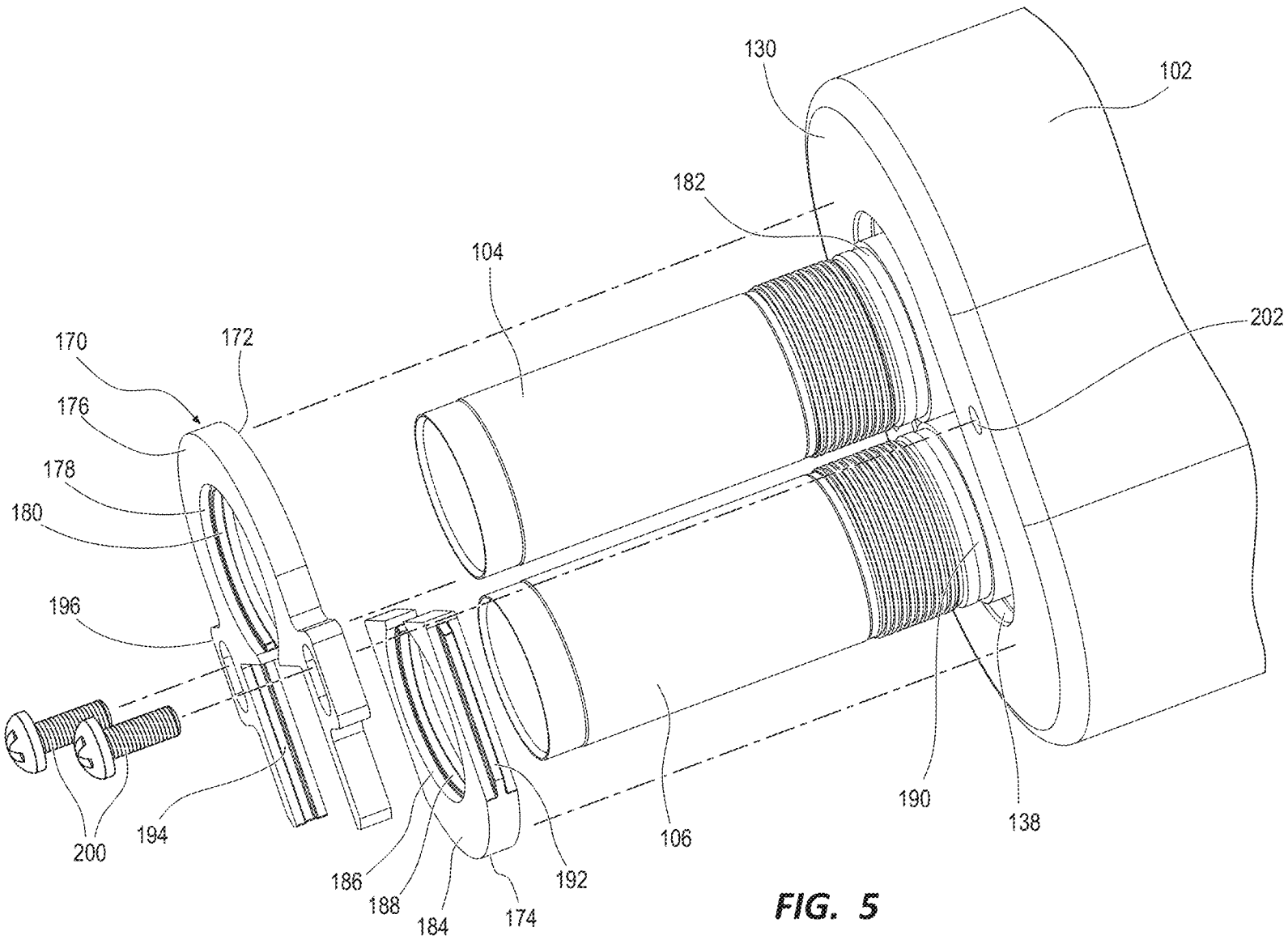
FIG. 5 is a view of a proximal end of the system shown in FIG. 4.

As shown in FIG. 5, a locking mechanism 170 can be utilized to secure the first tube 104 and the second tube 106 in the housing 102. The locking mechanism 170 can further secure the first tube 104 and the second tube 106 at a desired cant. The locking mechanism 170 can be adjustable to accommodate different barrel spacing or offset.

The locking mechanism 170 can comprise a top portion 172 and a bottom portion 174. The top portion 172 can include a ring 176 having an annular surface 178 with a tongue 180 to capture a groove 182 in the first tube 104. The bottom portion 174 can include a ring 184 having an annular surface 186 with a tongue 188 to capture a groove 190 in the second tube 106.

The top portion 172 and the bottom portion 174 of the locking mechanism 170 can slide together using a tongue 192 and a groove 194. The top portion 172 can comprise slots 196 for receiving fasteners 200. The fasteners 200 can secure the locking mechanism 170 to the inlet end 130 of the housing 102 using threaded bores 202. It will be appreciated that the locking mechanism 170 can be used on both the inlet end 130 and the outlet end 132 of the housing 102. Further, the top portion 172 and the bottom portion 174 are adjustable with respect to each other to accommodate different barrel spacing (offset) and cant.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A firearm suppressor system coupleable to a multi-barrel firearm having a first barrel and a second barrel, comprising:

a housing having an inlet end, an outlet end, and an outer sidewall that extends between the inlet end and the outlet end, wherein the inlet end, outlet end, and the outer sidewall define a central chamber inside of the housing;

a first opening formed in the inlet end of the housing;

a second opening formed in the outlet end of the housing;

a first tube having a first barrel engagement interface and a first bore axis; and a second tube having a second barrel engagement interface and a second bore axis, wherein the first tube and the second tube extend between the first opening and the second opening, and through the central chamber of the housing; wherein the first bore axis of the first tube and the second bore axis of the second tube define an angle; and wherein the first tube and the second tube are adjustable with respect to each other between a range of cant angles to thereby vary the angle.

2. The system of claim 1, further comprising a first locking mechanism for securing the first tube and the second tube in one of the range of cant angles.

3. The system of claim 2, further comprising a second locking mechanism for securing the first tube and the second tube in one of the range of cant angles.

4. The system of claim 3, wherein the one of the range of cant angles is 0.01° to 0.20°.

5. The system of claim 1, wherein the firearm is a double barrel shotgun.

6. The system of claim 1, wherein the first tube comprises a first plurality of ports.

7. The system of claim 6, wherein the second tube comprises a second plurality of ports.

8. The system of claim 7, further comprising an intermediate wall segregating the central chamber into a primary expansion chamber and a secondary expansion chamber having intermediate ports allows fluid communication between the primary expansion chamber and the secondary expansion chamber, wherein the secondary expansion chamber comprises a plurality of exit ports at a distal end to allow exhaust of gas separate from the first bore axis and the second bore axis, and wherein the primary expansion chamber has a first plurality of baffles defining a plurality of gas passageways between the first and second pluralities of ports and the secondary expansion chamber.

9. The system of claim 1, wherein the first barrel engagement interface comprises a first male threaded portion.

10. The system of claim 9, wherein the second barrel engagement interface comprises a second male threaded portion.

11. The system of claim 1, wherein the first tube further comprises a first choke engagement interface.

12. The system of claim 11, wherein the second tube further comprises a second choke engagement interface.

13. The system of claim 12, wherein the first choke engagement interface and the second choke engagement interface each comprises a female threaded portion.

14. The system of claim 1, wherein the first tube is rotatable about the first bore axis.

15. The system of claim 14, wherein the second tube is rotatable about the second bore axis.

16. A method of suppressing a multi-barrel firearm having a first barrel and a second barrel, comprising: installing a firearm suppressor system according to claim 1 onto the first barrel and the second barrel.

17. The method of claim 16, wherein the firearm is a double barrel shotgun.

18. A firearm having a first barrel and a second barrel comprising the firearm suppressor system according to claim 1 installed onto the first barrel and the second barrel.

19. The firearm of claim 18, wherein the firearm is a double barrel shotgun.

20. The firearm of claim 19, wherein the shotgun is one of an over and under shotgun and a side by side shotgun.

* * * * *